US006778155B2

(12) United States Patent
Doherty et al.

(10) Patent No.: US 6,778,155 B2
(45) Date of Patent: Aug. 17, 2004

(54) DISPLAY OPERATION WITH INSERTED BLOCK CLEARS

(75) Inventors: Donald B. Doherty, Richardson, TX (US); Gregory J. Hewlett, Blue Bell, PA (US)

(73) Assignee: Texas Instruments Incorporated, Dallas, TX (US)

( * ) Notice: Subject to any disclaimer, the term of this patent is extended or adjusted under 35 U.S.C. 154(b) by 324 days.

(21) Appl. No.: 09/918,837

(22) Filed: Jul. 31, 2001

(65) Prior Publication Data

US 2002/0012000 A1 Jan. 31, 2002

Related U.S. Application Data

(60) Provisional application No. 60/221,733, filed on Jul. 31, 2000.

(51) Int. Cl.[7] ..... G09G 3/34
(52) U.S. Cl. ..... 345/85; 345/84
(58) Field of Search ..... 345/84, 85; 359/223, 359/237, 238, 290, 291; 348/739, 744, 750

(56) References Cited

U.S. PATENT DOCUMENTS 5,278,652 A * 1/1994 Urbanus et al. ..... 348/571
5,497,172 A 3/1996 Doherty et al.
5,528,317 A 6/1996 Gove et al.
5,729,245 A * 3/1998 Gove et al. ..... 345/84
5,764,208 A 6/1998 Burton et al.
5,969,710 A 10/1999 Doherty et al.
6,008,785 A 12/1999 Hewlett et al.
6,115,083 A 9/2000 Doherty et al.
6,201,521 B1 3/2001 Doherty

FOREIGN PATENT DOCUMENTS

EP 0 883 295 A2 * 12/1998 ..... H04N/5/74

OTHER PUBLICATIONS

U.S. patent application Ser. No. 09/088,673, Doherty et al., filed Jun. 2, 1998.
U.S. patent application Ser. No. 09/413,582, Hewlett et al., filed Oct. 6, 1999.

* cited by examiner

*Primary Examiner*—Alexander Eisen
(74) *Attorney, Agent, or Firm*—Charles A. Brill; Wade James Brady, III; Frederick J. Telecky, Jr.

(57) ABSTRACT

An SLM PWM clocking method, called "jog clear," for generating short bit periods where block data clears (74) are inserted between block data loads (72, 76) within a frame refresh period. The method significantly reduces the short bit duration that requires use of the earlier reset-release method and it eliminates undesirable artifacts present in these earlier SLM clocking methods.

27 Claims, 6 Drawing Sheets

DISPLAY OPERATION WITH INSERTED BLOCK CLEARS

This application claims priority under 35 usc § 119(e)(1) of provisional application no. 60/221,733 filed Jul. 31, 2000.

BACKGROUND OF THE INVENTION

1. Field of the Invention

The present invention relates to spatial light modulator (SLM) projection displays and more specifically to an improved clocking method for improved display performance.

2. Description of the Related Art

To achieve a satisfactory degree of intensity resolution in a display system using pulse width modulation (PWM), some display time periods (bit times) can be shorter than the time required to reload the pixels of the SLM. For some SLMs, for example a digital micromirror device™ (DMD™), a technique for displaying such short bit times, called reset/release, causes the DMD mirrors to be released (to float in a flat state). Typically the DMD mirrors operate with dark field projection optics in a binary ON/OFF manner, for example mirrors tilted +10° (binary 1 memory state under the mirrors) are ON and reflect light into the aperture of a projection lens while mirrors tilted −10° (binary 0 memory state under the mirrors) reflect light into a 'dark trap' away from the projection lens. As a result, flat 0° mirrors are in an ambiguous state, which can allow stray light to enter the aperture, so as to degrade the contrast and exhibit undesirable memory effects. In addition, when used in a system incorporating the socalled block-reset technique, two additional artifacts can occur; i.e., (1) horizontal lines at the reset block boundaries, and (2) a "venetian blind" effect across the reset blocks.

FIG. 1 is a binary PWM sequence pattern for a SLM. The first diagram 10 shows one frame refresh period for a 5-bit binary system (5-bits are used for simplification, typical systems use 8-bits or more) with bits ranging from the least significant bit (LSB) 100 to the most significant bit (MSB) 104. Bit 0 100, the LSB, accounts for $1/(2^n-1)$ of the refresh period, where n is the number of bits. Then each succeeding bit represents double the time of its preceding bit; e.g., bit 1 101 represents 2× LSB, bit 2 102 represents 4× LSB, bit 3 103 represents 8× LSB, bit 4 104 represents 16× LSB, of the total refresh time. In a DMD, the memory cell under the mirror is addressed in a binary fashion according to this PWM sequence. The mirrors tilt ±X degrees depending on the binary state of its memory cell; e.g.; a mirror might tilt +10° if its associated memory cell has a binary 1 state and −10° if its memory cell has a binary 0 state. The second diagram 11 is an example of a memory cell, whose PWM sequence is binary 01111. When bit 0, 1, 2, or 3 is loaded, the memory cell is a binary state 1 and when reset to this state the mirror is ON and reflects light into the lens aperture. When bit 4 is loaded, the memory cell is a binary state 0 and when reset to this state the mirror is OFF and reflects light away from the lens aperture into a 'dark trap'. In this case, the mirror reflects light for 15/31 or 48% of the refresh period and is dark for 16/31 or 52% of the refresh period, since the MSB is a binary 0.

The human visual system effectively integrates the pulsed light from the mirror to form the perception of a level of light intensity. The gray scale level is proportional to the percentage of time the mirror is ON during the refresh time. The 48% level of the above example represents a gray level near the middle of the scale from black to white intensity.

Similarly, the third diagram 12 is an example of a memory cell, whose PWM sequence is binary 11010. When bit 1, 3 or 4 is loaded, the memory cell is a binary state 1 and when reset to this state the mirror is ON and reflects light into the lens aperture. When bit 0 or 2 is loaded, the memory cell is a binary state 0 and when reset to this state the mirror is-OFF and reflects light away from the lens aperture into a 'dark trap'. In this case, the mirror reflects light for 26/31 or 84% of the refresh period and is dark for 5/31 or 16% of the refresh period.

In a PWM SLM (example DMD), the device is loaded with the MSB and left for approximately ½ the refresh time, then loaded with the second MSB and left for ¼ the refresh time, then loaded with the third MSB and left for ⅛ the refresh time, and so on until the LSB is loaded and left for $1/(2^n-1)$ of the refresh time. However, it is not necessary to load and reset a bit and leave it for the full duration of time. Instead, the longer MSB periods can be broken into smaller segment, which are distributed throughout the refresh time and the mirror is addressed multiple times so as to add up to the total bit period duration. This technique, called "bitsplitting," is illustrated in FIG. 2 and can create a more pleasing image over that of leaving the mirror in one position for the whole bit period. The first diagram 20 shows the PWM-example of FIG. 1 using "bit-splitting". If the SLM is a DMD, the memory cells can be loaded without affecting the state of the mirrors since the mirror superstructure has an inherent mechanical latch that allows the mirrors, once reset, to remain in that state independent of the memory cell state until the mirrors are once again reset. As a result, the cells can be loaded without upsetting the previous mirror state. It is desirable to continuously load the memory and reset the mirrors after equal intervals of time. In the diagram 20 bit 1 is loaded once during the refresh period and left for a period of time. Bit 2 is loaded twice during the refresh period and left each time for the same time as bit 1. Similarly, bits 3 and 4 are loaded 4 and eight times, respectively, during the refresh period and each time left for the same period of time as bit 1. However, notice in the diagram that bit 0 is loaded and left in its state for a period of time equal to only ½ that of bit 1. The reason for this is that bit 0 has only ½ the weight of bit 1. In this example, there is not enough time to load the memory array during bit 0. Herein lies the problem to be address by this invention. But first, the second diagram 21 shows the "bitsplitting" example for the 48% intensity level discussed in FIG. 1. Here bit 1 is a binary 1 for one split-bit (sb) period, bit 2 is a binary 1 for two separate sb periods, bit 3 is a binary 1 for four separate sb periods, and bit 4 is a binary 0 for eight sb periods, but bit 0 is a binary 1 for only ½ split-bit period. Similarly, the third diagram 22 shows the "bit-splitting" example for the 84% intensity level discussed in FIG. 1. Here bit 0 is a binary 0 for ½ a split-bit period, bit 1 is a binary 1 for one split-bit (sb) period, bit 2 is a binary 0 for two separate sb periods, bit 3 is a binary 1 for four separate sb periods, and bit 4 is a binary 1 for eight sb periods.

SLMS, and DMDs in particular, have typically been addressed globally; i.e., all cells are addressed and then reset simultaneously, as illustrated in FIG. 3. While data is being loaded into the DMD, the mirrors remain in their previous state due to a bias voltage, which is applied to the mirror superstructure. That is, after the device is loaded with the new data bit plane, the bias voltage is reset, allowing the mirrors to assume their respective state corresponding to this new bit plane. FIG. 3 shows the memory being loaded, the reset pulse, the corresponding multiple split-bits being displayed, and the PWM sequence for the bits. For example, in operation, while bit 3 is displayed 30, bit 4 is being loaded into memory 31. Once bit 4 is loaded, the reset pulse 32 is applied causing the mirrors to go to the new bit 4 state 33. Then while bit 4 is displayed 33, bit 2 is loaded into memory 34 and the reset pulse 35 is applied causing the mirrors to go to the next bit state 2 36, and so on throughout the PWM sequence 37.

As mentioned earlier, a fundamental limitation of this load-reset method occurs when a split-bit (bit 0) requires a shorter display duration than the time needed to load the entire device's memory cells. In the past, this problem has been overcome by using a clear operation rather than a reset operation for bit 0, since in a DMD a global clear can be performed in a small fraction of the time required to load the entire device. FIG. 4 illustrates this technique for generating the required ½ split-bit period for bit 0, which again shows the memory being loaded, the reset pulse, the corresponding displayed bits, and the PWM sequence 400. The operation is the same except for bit 0. For example, bit 4 is loaded into memory 40, while bit 3 is displayed 41, and then the reset pulse 42 is used to reset the mirrors to their bit 4 state 43. Bit 0 is then loaded into memory 44 in a normal manner and the reset pulse 45 is applied to reset the mirrors to the bit 0 state 46. However, a global clear 47, where all bits are set to 0 state, is executed and part way through the bit 0 split-bit period reset pulse 48 is applied, which quickly turns all mirrors OFF 49, where they remain for one split-bit period while the next normal bit 1 is loaded into memory 401. This technique provides the desired "short" bit, but it requires that all the mirrors remain OFF for one split-bit period 49, which significantly decreases the system brightness. In addition, if the system speed requires that the bit 0 time becomes too short to allow for a global clear of the device, this technique will not work.

More recently, a new DMD architecture called phased-reset has been used to overcome the problems discussed above for generating the "short bit" in a global reset device. FIG. 5 shows a portion of the PWM sequence 50 for phased-reset operation of a DMD. In this approach, the DMD is partitioned into blocks; e.g., a 640×480 VGA DMD may be divided into 12 horizontal blocks of 640×40 pixels (mirrors) each. In the example of FIG. 5, the device is divided into eight blocks. Two distinctions are made for these phased-reset devices over global devices, as follows:

(1) each block can be loaded and reset independently from the other blocks, and (2) load and reset functions within a given block are no longer tied together, but may be separated by a period of time. (For global operation, a reset immediately follows a load)

In phased-reset operation, each reset block is independently loaded and reset. In this case, bit 4 is loaded and reset 52, on a phased block basis, while bit 3 is being displayed 51. Since the display period of bit 0 is too short to allow the entire device to be loaded, the bit 0 data is loaded, but the mirrors are not immediately reset, early in the bit 4 display period. At the appropriate time, a block of mirrors is reset 55, allowing them to be displayed 53 in the appropriate bit 0 state. Then bit 1 is loaded and an immediate reset 56 is applied in a normal manner, allowing the mirror to go to the bit state. The process then continues with the loading and reset of the next block of mirrors. After all of the bit 0 display periods are complete and the bit 1 periods started, the process continues with bit 4. In this method, bit 0 need not fully accommodate a device load because the phased structure allows for the display time of the next normal bit to begin immediately as the different blocks are loaded. This method overcomes the need to turn the mirrors OFF while loading the next normal bit, which causes degradation in the system brightness, as discussed earlier, but it does extend the MSB time somewhat. However, this method works as long as the block loading time plus the mirror settling time is less than the bit 0 time.

In modern systems where the bit times are continuously becoming shorter and shorter, it is possible for the bit 0 time to be shorter than the block loading time plus mirror settling time of bit 0. FIG. 6*a* is a diagram showing another approach, called reset-release timing, used in a phased system where the block loading time plus the mirror settling time is longer than the bit 0 time. The difference here from the phased reset method discussed above is that at the end of the reset-release period the mirrors are released to a flat state and held while the next bit is loaded. This is accomplished by turning the mirror bias OFF and allowing them to float around the 0° position. This shows the data to be loaded into memory, the reset timing, and the reflected light response from the mirrors. While the mirrors are in their selected state from normal bit A 600, the reset-release (rr) bit is loaded 601 into memory, but the mirrors are not reset immediately. At the appropriate time (after delay), a reset pulse 602 occurs setting the mirrors 603 according to the rr data in memory. Then at the end of the short bit 0 period, the mirrors are released 604 by turning OFF the mirror bias 605. In the absence of a bias, the mirrors go to a flat state 606 and remain there while data for the next normal bit B 607 is loaded into memory. The bias is then turned back ON 608 and the mirrors assume their bit B positions 609. The graph to the right of the diagram is a plot of the reset timing pulse 610 and the optical response 611 from the mirrors. The rr artifacts 612 are also shown with some stray light getting into the lens aperture causing undesirable artifacts.

FIG. 6*b* illustrates the timing for the reset-release method of FIG. 6*a*. This diagram shows a normal bit A being loaded 60 and reset 61, then the reset-release (rr) bit is loaded 62 but not immediately reset in the normal fashion. Then at the appropriate time the rr bit is reset 63, allowing the mirrors to go to their appropriate state, and released 64 at the end of the bit 0 time period, when the mirror bias is turned OFF. Once released, the mirrors go to and remain in a flat (approximately 0°) position while the next bit B is loaded 65. Once loaded, the mirror bias is turned back ON 66 allowing the mirrors to go to their new state (+10° or −10°) at which point the normal sequence of loading 67 and resetting 68 the next bit continues. The problem with the reset-release method is that the flat mirrors lead to additional optical artifacts, such as stray light entering the aperture causing horizontal lines at the reset block boundaries, a "venetian blind" effect across the reset blocks, and lower system contrast due to higher dark levels.

What is needed is a method to turn the mirrors OFF while loading the next bit after the short bit in order to avoid the undesirable artifacts of the method(s) discussed above. However, this is not a trivial matter for such short bit times and is complicated by the fact that the combination of data and reset operations are performed independently on each block in a phased manner. In addition, matters are further complicated by the additional restrictions that a block clear cannot be performed on one block while loading another block. However, the method of this invention addresses these needs and provides a high performance solution, albeit with some limitations as to DMD type and bit ordering.

SUMMARY OF THE INVENTION

This invention discloses a DMD PWM clocking method, called "jog clear", for generating short bit periods where block data clears are inserted between block data loads within a frame refresh period. The method significantly reduces the minimum short bit duration without requiring reset-release methods.

Short bit times are needed for the LSB(s) in PWM devices, such as the DMD, where the memory load and mirror settling times are greater than the split-bit display time. Currently, techniques such as reset-release are used to generate these short bit periods, but this requires that the mirrors be released to the flat state while data for the next normal bit is loaded into memory. Having the mirrors flat even for a short period of time reduces the contrast and brightness of the system and introduces artifacts in the form of horizontal lines at the block boundaries and generates a "venetian blind" effect across blocks.

The jog-clear method of this invention causes the mirrors to turn OFF while data for the next bit is loaded, thereby eliminating these undesirable artifacts. However, quickly turning the mirrors OFF to a dark state is a non-trivial matter since the combination of data and reset operations have to be performed independently on each group in a phased manner and is further complicated by the fact that one block cannot be cleared while another block is being loaded. This introduces a skew in the short bit timing, which must be removed elsewhere within the frame refresh period.

The jog-clear method of this invention requires that the DMD/controller be capable of quickly clearing a reset block between loads of two other reset blocks. Such devices are now available, for example a 0.7-inch diagonal XGA DMD, as well as others. The method also introduces bit-ordering limitations to deal with removing the skew from each frame refresh period.

Major advantages of this new method include:

the elimination of visible lines at block boundaries,
the elimination of the "venetian blind" effect, and
significantly reduced black level.

DETAILED DESCRIPTION

This invention discloses a DMD PWM clocking method, called "jog clear", for generating short bit periods where block data clears are inserted between block data loads within a frame refresh period. The method significantly reduces the minimum short bit duration without requiring reset-release methods and eliminates several artifacts found in earlier clocking methods.

In the jog-clear method, a block clear is performed during the short bit period (s_time). As a result, instead of a reset-release of the mirrors (with unstable flat mirrors), a clear-reset latches the mirror into the OFF (dark) state for the duration of time it takes to load the memory for the next normal bit. The invention centers around the novel technique used to achieve this dark state in very short periods of time. A critical aspect of the method is the requirement that the SLM is capable of being cleared with zero data generated internal to the SLM, generally several rows at a time, while not affecting the data in any other reset block.

Figure 6A:
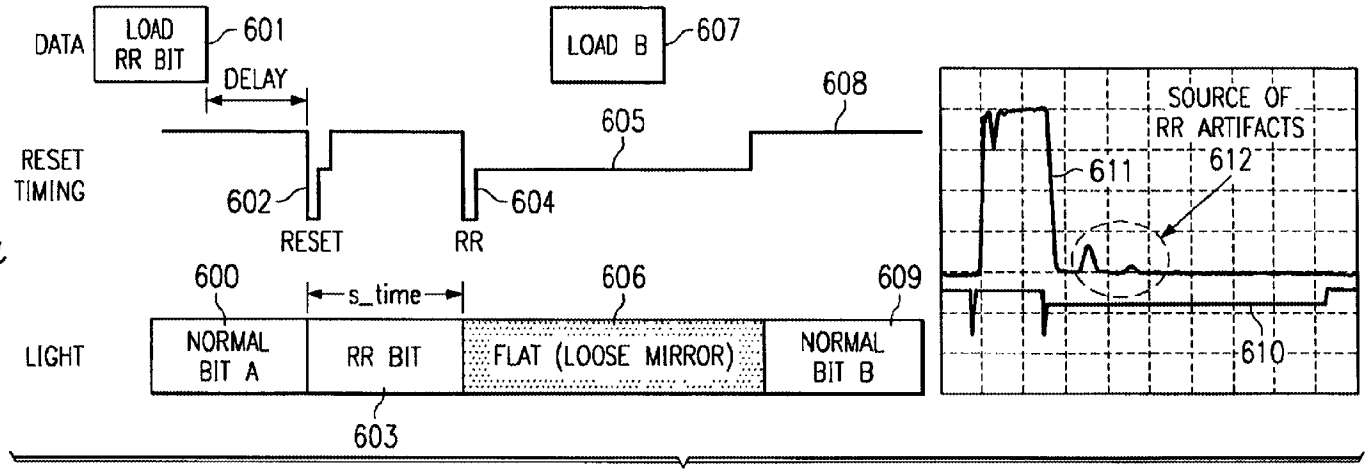
FIG. 6a (PRIOR ART)
FIG. 6*a* is a diagram showing a phased DMD operated with the reset-release technique where the mirrors are allowed to float in the flat state during the loading of the next bit after the short LSB bit, along with a response curve showing the optical artifacts that are present. (prior art)
Figure 7A:
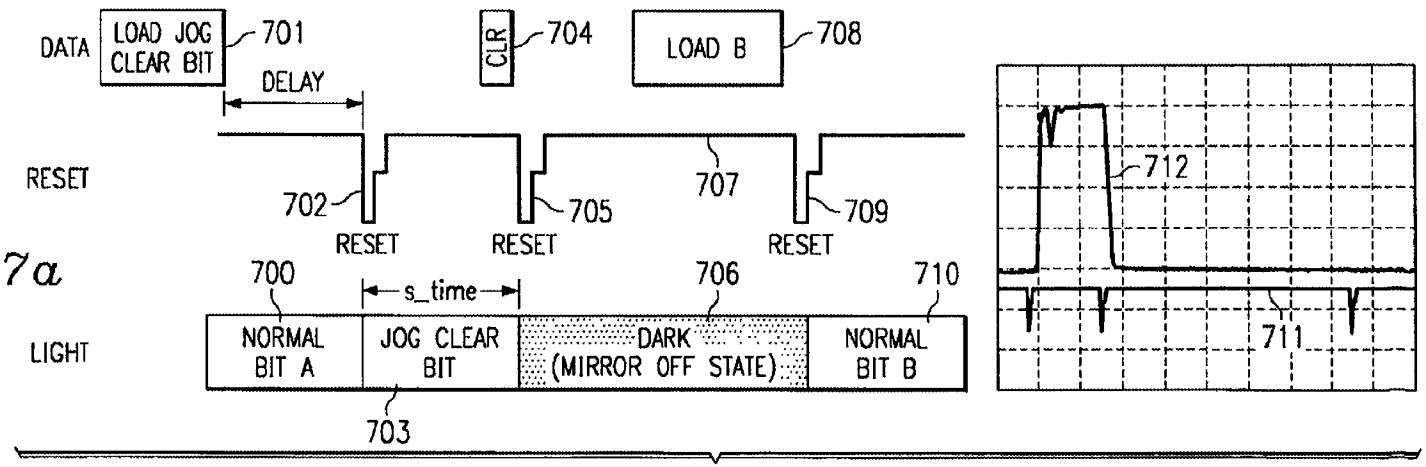
FIG. 7*a* is a diagram showing a phased DMD operated with the jog-clear method of this invention where the mirrors in each block are quickly cleared to the dark state in a phased manner.
Figure 6B:
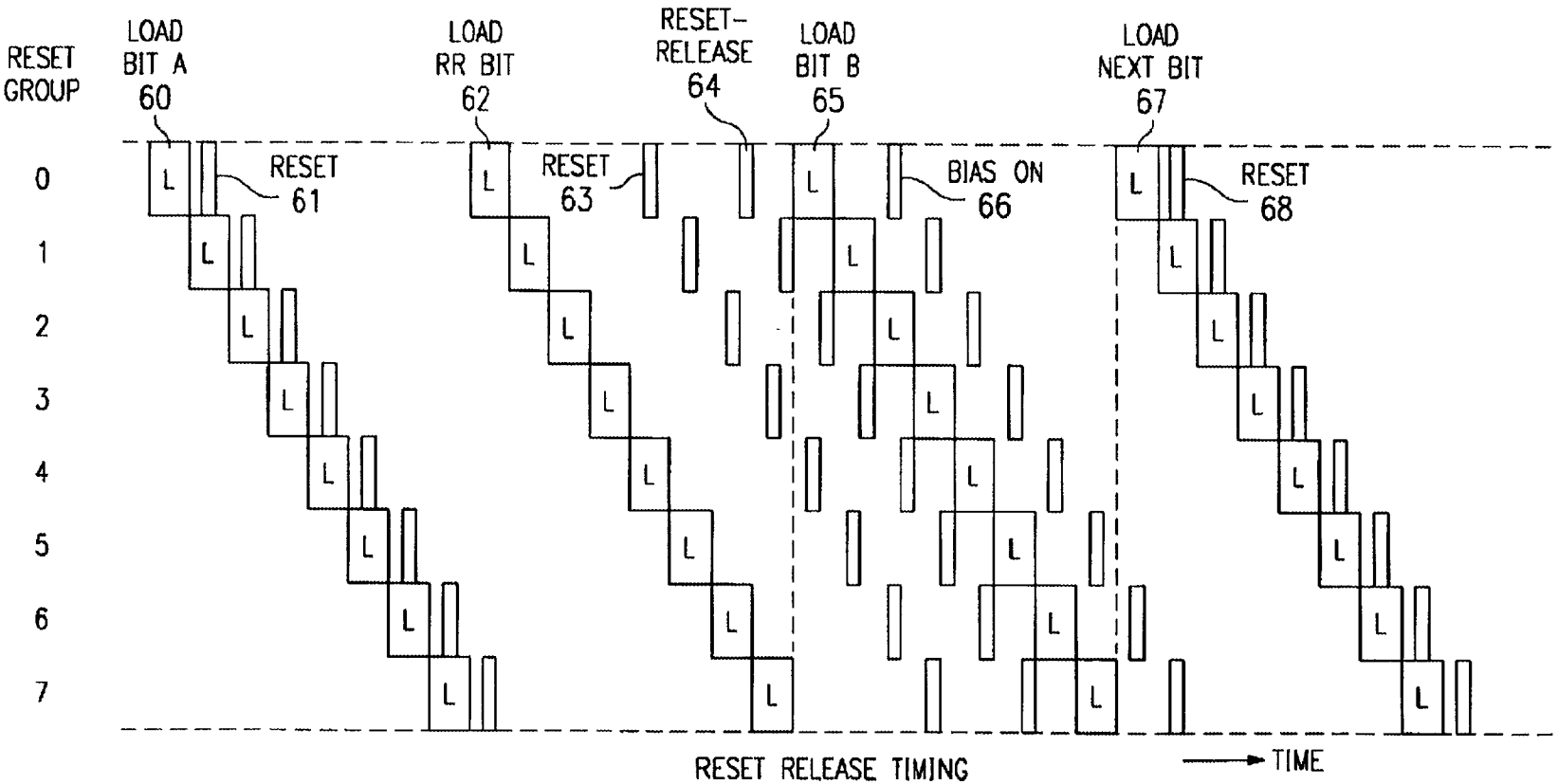
FIG. 6b (PRIOR ART)
FIG. 6*b* is a timing diagram further illustrating the reset-release method of operating a DMD along with a response curve showing the optical artifacts that exist. (prior art)

FIG. 7*a* is a diagram showing the jog-clear method of this invention used in a phased system. Although this looks similar to the reset-release method of FIG. 6*a*, the difference is that the jog-clear bit is loaded and then the mirrors are cleared to the dark state in phased blocks. FIG. 7*a* shows the data to be loaded into memory, the reset timing, and the reflected light response from the mirrors. While the mirrors are in their selected state from normal bit A 700, the jog-clear bit is loaded 701 into memory, but the mirrors are not immediately reset. The mirrors are then reset at the appropriate time 702 (after delay) to display 703 the short bit. Then the memory is loaded with clear data (all 0's) 704 and a reset pulse 705 clears all the mirrors in a block precisely at the end of the short bit period, forcing all mirrors to the OFF (dark) state 706 while data for the next normal bit B is loaded 708 into memory. Finally, a reset pulse 709 causes the mirrors to go to their normal bit B state 710. Notice in this diagram that during the dark state, while load B 708 is underway, the bias voltage 707 is still applied to the mirrors and since all memory locations are set to binary 0, all mirrors are OFF. The graph to the right of the diagram is a plot of the reset timing pulse 711 and the optical response 712 from the mirrors. This clearly shows that the artifacts in the earlier reset-release method have been eliminated.

Figure 7B:
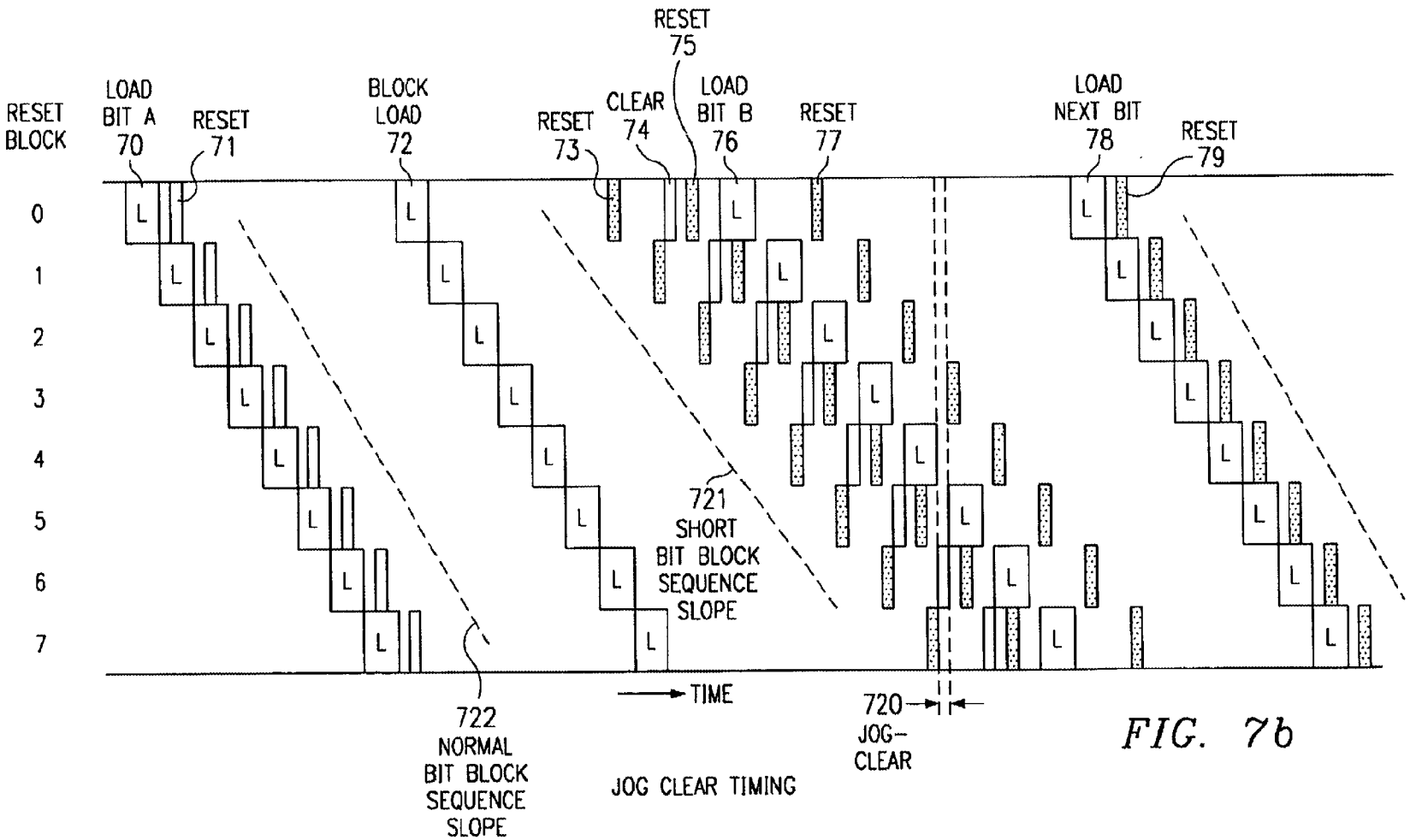
FIG. 7*b* is a timing diagram further illustrating the jog-clear method of operating a DMD along with a response curve showing the elimination of undesirable optical artifacts.

FIG. 7*b* illustrates the timing for the jog-clear method of FIG. 7*a*. This diagram shows a normal bit A being loaded 70 and reset 71, then the data for the short bit is loaded 72 but not immediately reset in the normal fashion. Then at the appropriate time this jog-clear bit is reset 73 setting the mirrors to their short bit state. Next, the clearing function is applied to terminate the short bit at the appropriate time. The clear data is loaded 74 and the mirrors reset 75 at the end of the short period, but the mirror bias is still applied so that the mirrors are turned OFF (tilted to 10° position) while bit B is loaded 76 and reset 77. The normal load bit 78 and reset mirrors 79 sequence then continues through the frame.

The seemingly straightforward process of placing the block clear between two block loads is further complicated by the fact that in current DMDs a clear on one block of data cannot occur while another block is being loaded. Notice in the diagram of FIG. 7*b* that when jog-clear in block 6 (example) 720 occurs, there is no other activity going on in the device. This mandates a spreading out in time of the DMD block loads, which causes a skew 721 (change in slope) for the short-bit block sequence relative to the skew 722 for a normal-bit block sequence. The change in skew produces times for bit A (from reset 71 to reset 73) that are shorter for the first blocks reset (e.g., 0, 1, 2, . . . ) than for later reset blocks (e.g., . . . , 5, 6, 7). Similarly, the times for bit B (from reset 77 to reset 79) are longer for the first reset blocks than for blocks reset later in the cycle. If not corrected, this condition would cause non-uniform weights for bits A and B and thus visible artifacts. This skew is acceptable as long as it is removed elsewhere in the sequence, as it is in the method of this invention. To remove this skew, the bit-ordering restrictions described below must be applied.

Use of the jog-clear method adds bit-ordering restrictions to the system sequence. For example, in a 9-bit system where bits 8 and 9 are normal bits, and bits 0 and 1 are jog-clear bits, one of the following bit sequences can be used:

(1) sandwich skew: 9-0-9; a jog-clear must be surrounded on both sides by the same bit, or
(2) opposite adjacent skew: 9-0-8 . . . 8-9; the bits surrounding the jog clear bit must be adjacent in the opposite order elsewhere in the sequence(s) and must be reset with the same skew as that of the jog-clear bit, or
(3) paired skew: 9-0-8 . . . 8-1-9; the jog-clear bit may be paired with another jog-clear bit, surrounded by the same bits in opposite order.

As FIG. 7*b* shows, inserting block clears between block loads also requires the external manipulation of the DMD row address. For instance, after the load of bit B 76 for block 0, the DMD address must be moved down to block 2 to continue the clear 74 for block 2. After that block clear, the address must be returned to the top of block 1 to continue the load of bit B for block 1. This process, where the DMD address "jogs" back and forth as the block clears occur, requires both an external control circuit to manage it and a DMD that can respond appropriately. Some DMDs have random row address capability for which the control circuit simply computes the next row address and supplies it to start each block operation. Another class of DMDs can only adjust the row address sequentially forward or backward. The control circuit for these DMDs sets a count direction and directs the DMD to count the number of times necessary to advance the row count to the correct block. Some of these DMDs can advance row addresses in multiple rows per count. The control circuit can use this fast counting mode to decrease the counting time and minimize the skew.

Figure 1:
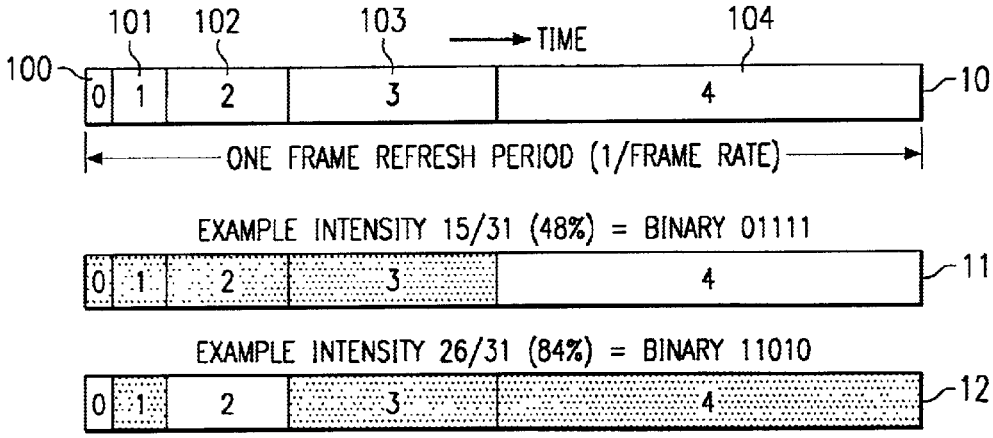
FIG. 1 (PRIOR ART)
FIG. 1 is a 5-bit binary PWM sequence pattern for a DMD along with two examples of how intensity values are generated. (prior art)
Figure 2:
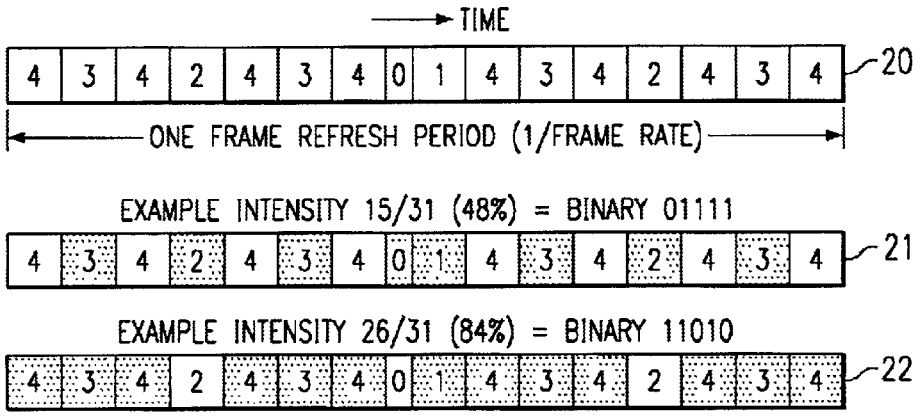
FIG. 2 (PRIOR ART)
FIG. 2 is a PWM sequence pattern for a DMD incorporating the bit-splitting technique along with two examples of how intensity values are generated. (prior art)
Figure 8:
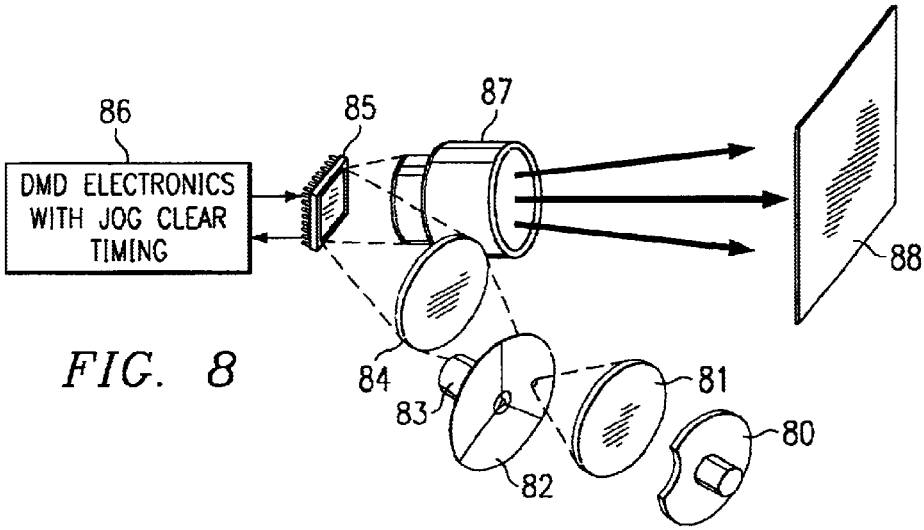
FIG. 8 is a block diagram of a single modulator, color field-sequential, projector operated with the jog-clear method of this invention.
Figure 3:
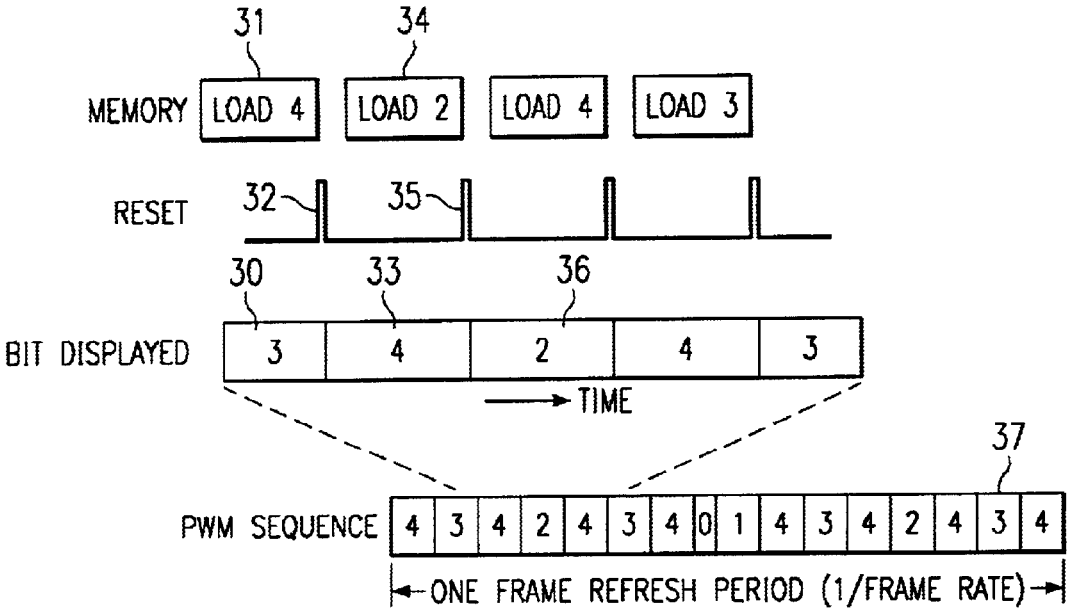
FIG. 3 (PRIOR ART)
FIG. 3 is a diagram showing the memory load and mirror reset functions for a portion of a refresh frame in a global operated DMD. (prior art)
Figure 4:
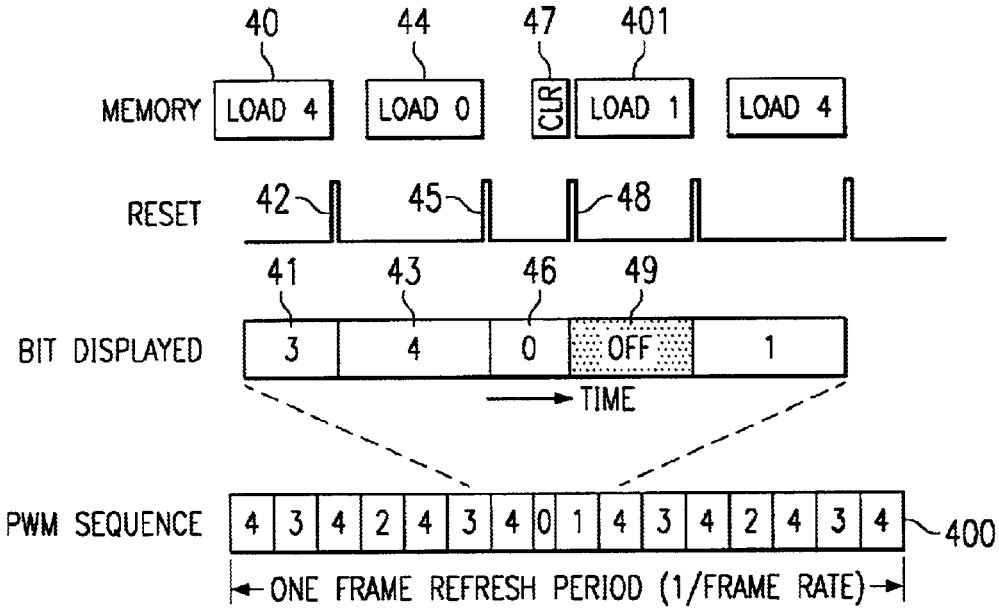
FIG. 4 (PRIOR ART)
FIG. 4 is a timing diagram showing the global reset function for a DMD, where the mirrors are held in the dark state while bit 1 is loaded when bit 0 is too short to accommodate a device load. (prior art)
Figure 5:
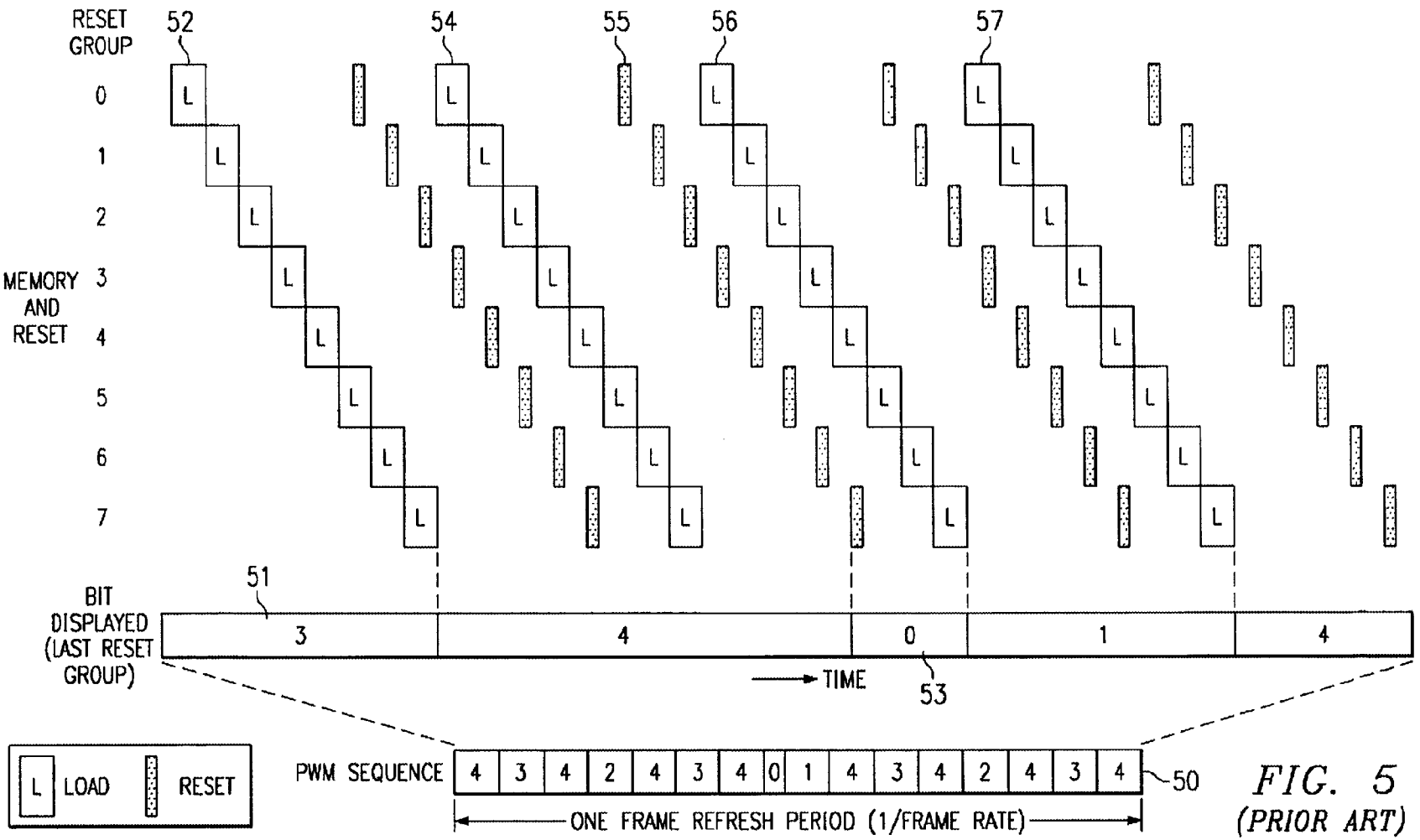
FIG. 5 (PRIOR ART)
FIG. 5 is a timing diagram showing the load and reset operations in a phased reset DMD, where each block of mirrors is independently loaded and reset without the need for a period when the mirrors are dark. (prior art)

FIG. 8 is an example of a single-DMD projection display, which uses the jog-clear method of this invention to provide a brighter picture with far less artifacts. The system is comprised of a light source 80, a first condenser lens assembly 81, a color wheel 82 and motor 83, a secondary condenser lens assembly 84, a DMD 85, the DMD electronics that among other operations performs the jogclear algorithm of this invention 86, a projection lens assembly 87, and a viewing screen 88.

While this invention has been described in the context of a preferred embodiment, it will be apparent to those skilled in the art that the present invention may be modified in numerous ways and may assume embodiments other than that specifically set out and described above. Accordingly, it is intended by the appended claims to cover all modifications of the invention that fall within the true spirit and scope of the invention.

What is claimed is:

1. A method of operating an SLM, said method comprising:

loading a first bit of display data in a block of SLM elements;

resetting said SLM elements to display said first bit of display data;

loading clear data in said block of SLM elements, said clear data loaded into groups of said SLM elements such that said step of loading clear data takes less time than said step of loading said first bit of display data;

resetting said SLM elements to display said clear data;

loading a second bit of display data in said block of SLM elements;

resetting said block of SLM elements to display said second bit of display data; and wherein a duration during which a bit of display data displayed prior to said first bit of display data is not the same for all blocks and said display duration of said prior bit is equalized over a frame period by reloading and displaying said prior and said second bits of display data consecutively in an opposite order at another time during said frame period.

2. The method of claim 1, said first bit of display data displayed for a duration less than a sum of an element settling time and a block load time.

3. The method of claim 1, wherein said clear data latches said elements in an OFF state.

4. The method of claim 3, wherein elements remain in said OFF state while a subsequent bit of display data is loaded into said elements.

5. The method of claim 1, further comprising the step of selecting a current block to load.

6. The method of claim 1, further comprising the step of selecting a current block to load by incrementing or decrementing a block address.

7. The method of claim 5, further comprising the step of selecting a current block to load supplying a block address signal.

8. The method of claim 1, further comprising the steps of:

loading a first bit of display data in at least one additional block of SLM elements;

resetting said additional block of SLM elements to display said first bit of display data;

loading clear data in said additional block of SLM elements; and resetting said additional block of SLM elements to display said clear data.

9. The method of claim 8, further comprising the step of loading some, but not all, of said additional blocks with a second bit of display data prior to resetting all of said blocks to display said clear data.

10. The method of claim 1, wherein said display duration of said prior bit is different for each of said blocks.

11. The method of claim 1, wherein said display duration of said prior bit for each given block is longer than said display duration of said prior bit for each block reset prior to said given block.

12. The method of claim 1, wherein said display duration of said prior bit is equalized over a frame period by reloading said prior bit of display data as said second bit of display data.

13. The method of claim 1, wherein said display duration of said prior bit is equalized over a frame period by reloading and displaying said prior and said second bits of display data in an opposite order at another time during said frame period separated by another bit that is loaded, reset, and followed by a clear period in the same manner as said first bit.

14. The method of claim 8, wherein some, but not all, of said additional blocks of SLM elements are loaded with said clear data prior to resetting all of said blocks to display said first bit of display data.

15. The method of claim 14, wherein a duration during which a bit of display data displayed prior to said first bit of display data is not the same for all blocks.

16. The method of claim 15, wherein said display duration of said prior bit is different for each of said blocks.

17. The method of claim 15, wherein said display duration of said prior bit for each given block is longer than said display duration of said prior bit for each block reset prior to said given block.

18. The method of claim 15, wherein said display duration of said prior bit is equalized over a frame period by reloading said prior bit of display data as said second bit of display data.

19. A projection display comprising:

a light source for producing a beam of light along a first light path;

control electronics for receiving image data and providing control signals and display data representing said image data; and a spatial light modulator on said first light path for receiving said control signals and said display data and for selectively modulating said beam of light in response to display data, said spatial light modulator comprised of and array of modulator elements, said modulator elements grouped into at least two blocks;

said control electronics operable to: load a first bit of display data in a first of said blocks, reset said first of said blocks to display loaded data, and load clear data in said first block, said clear data loaded into said first block faster than said first bit of said display data, wherein some of additional blocks of modulator elements are loaded with a second bit of display data prior to resetting all of said blocks to display said clear data said control electronics operable to display a bit prior to said first bit of display data for a duration, said duration of said prior bit not the same for all said blocks said control electronics operable to compensate said duration of said prior bit and a duration of a second bit of display data displayed immediately after said clear data over a frame period by reloading said prior and said second bits of display data in an opposite order at another time during said frame period.

20. The display system of claim 19, said control electronics further operable to loading some, but not all, of said additional blocks with a second bit of display data prior to resetting all of said blocks to display said clear data.

21. The display system of claim 19, said control electronics further operable to compensate said duration of said prior bit by reloading said prior bit following said clear data.

22. The display system of claim 19, said control electronics further operable to compensate said duration of said prior bit and a duration of a second bit of display data displayed immediately after said clear data over a frame period by reloading said prior and said second bits of display data in an opposite order at another time during said frame period separated by another bit that is loaded, reset, and followed by a clear period in the same manner as said first bit.

23. A projection display comprising:

a light source for producing a beam of light along a first light path;

control electronics for receiving image data and providing control signals and display data representing said image data; and a spatial light modulator on said first light path for receiving said control signals and said display data and for selectively modulating said beam of light in response to display data, said spatial light modulator comprised of and array of modulator elements, said modulator elements grouped into at least two blocks;

said control electronics operable to: load a first bit of display data in a first of said blocks, reset said first of said blocks to display loaded data, and load clear data in said first block, said clear data loaded into said first block faster than said first bit of said display data, wherein some, but not all, of additional blocks of modulator elements are loaded with said clear data prior to resetting all of said blocks to display said first bit of display data, said control electronics further operable to compensate said duration of said prior bit and a duration of a second bit of display data displayed immediately after said clear data over a frame period by reloading said prior and said second bits of display data in an opposite order at another time during said frame period.

24. The display system of claim 23, said control electronics further operable to loading some, but not all, of said additional blocks with a second bit of display data prior to resetting all of said blocks to display sad clear data.

25. The display system of claim 23, said control electronics further operable to display a bit prior to said first bit of display data for a duration, said duration of said prior bit not the same for all said blocks.

26. The display system of claim 23, said control electronics further operable to compensate said duration of said prior bit by reloading said prior bit following said clear data.

27. The display system of claim 23, said control electronics further operable to compensate said duration of said prior bit and a duration of a second bit of display data displayed immediately after said clear data over a frame period by reloading said prior and said second bits of display data in an opposite order at another time during said frame period separated by another bit that is loaded, reset, and followed by a clear period in the same manner as said first bit.

* * * * *